US009673558B2

(12) United States Patent
Frey et al.

(10) Patent No.: US 9,673,558 B2
(45) Date of Patent: Jun. 6, 2017

(54) SYSTEMS AND METHODS FOR MAINTAINING PRESSURE ON AN ELASTOMERIC SEAL

(71) Applicant: Baker Hughes Incorporated, Houston, TX (US)

(72) Inventors: Jeffrey G. Frey, Broken Arrow, OK (US); Christopher J. Layton, Claremore, OK (US); Terry L. Glasscock, Vinita, OK (US); Adam L. Gibson, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 76 days.

(21) Appl. No.: 14/704,390

(22) Filed: May 5, 2015

(65) Prior Publication Data

US 2015/0325943 A1 Nov. 12, 2015

Related U.S. Application Data

(60) Provisional application No. 61/990,539, filed on May 8, 2014.

(51) Int. Cl.

| | |
|---|---|
| ***H01R 13/52*** | (2006.01) |
| ***H01R 13/512*** | (2006.01) |
| ***H01R 13/502*** | (2006.01) |
| *E21B 17/02* | (2006.01) |

(52) U.S. Cl.

CPC ..... *H01R 13/512* (2013.01); *H01R 13/502* (2013.01); *H01R 13/521* (2013.01); *E21B 17/023* (2013.01); *H01R 13/5208* (2013.01); *H01R 13/5216* (2013.01)

(58) Field of Classification Search

None

See application file for complete search history.

(56) References Cited

U.S. PATENT DOCUMENTS

| | | | | |
|---|---|---|---|---|
| 5,286,220 A * | 2/1994 | Watson | H01R 13/523 | 439/276 |
| 5,873,750 A * | 2/1999 | Cairns | H01R 13/523 | 439/587 |
| 6,431,912 B1 * | 8/2002 | Mori | B60L 11/1818 | 439/310 |

(Continued)

*Primary Examiner* — Tho D Ta

(74) *Attorney, Agent, or Firm* — Law Offices of Mark L. Berrier

(57) ABSTRACT

Systems and methods for maintaining a desired compressive force on seals in an electrical junction such as a pothead connector for an ESP motor. In one embodiment, insulated conductors of a power cable extend into a housing of a connector. The insulated conductors pass through an upper insulator, a set of elastomeric boot seals, and a lower insulator. O-rings are positioned between the upper insulator and the housing of the pothead connector. The lower insulator is secured to the upper insulator by a set of bolts and springs that urge the lower insulator toward the upper insulator, compressing the boot seals. The bolts are threaded into the upper insulator and are tightened to compress the springs against the lower insulator. The compression of the boot seals between the insulators maintains a desired range of contact pressure against the seals despite changes in the seal dimensions.

18 Claims, 5 Drawing Sheets

(56) References Cited

U.S. PATENT DOCUMENTS

| | | | | |
|---|---|---|---|---|
| 6,641,421 | B1 * | 11/2003 | Leavitt | H01R 13/53 439/271 |
| 6,676,447 | B1 * | 1/2004 | Knox | H01R 13/523 439/274 |
| 7,789,689 | B2 * | 9/2010 | Frey | H01R 13/523 439/275 |
| 7,942,696 | B2 * | 5/2011 | Watson | E21B 17/023 439/589 |
| 8,398,420 | B2 * | 3/2013 | Watson | E21B 17/025 439/275 |
| 8,491,282 | B2 * | 7/2013 | Shaver | F04B 47/06 277/608 |
| 8,512,074 | B2 * | 8/2013 | Frey | H01R 13/523 439/279 |
| 2012/0012822 | A1 | 1/2012 | Kakiuchi et al. | |
| 2012/0100737 | A1 | 4/2012 | Frey | |

* cited by examiner

SYSTEMS AND METHODS FOR MAINTAINING PRESSURE ON AN ELASTOMERIC SEAL

CROSS-REFERENCE TO RELATED APPLICATIONS

This application claims the benefit of U.S. Provisional Patent Application 61/990,539, filed May 8, 2014, which is incorporated by reference as if set forth herein in its entirety.

BACKGROUND

Field of the Invention

The invention relates generally to power subsystems for downhole equipment such as electrical submersible pumps (ESP's), and more particularly to means for maintaining a desired amount of compressive force applied to an elastomeric seal.

Related Art

Downhole equipment such as ESP systems are commonly installed in wells for purposes of producing fluids (e.g., oil) from the wells. Power suitable to drive the equipment is produced at the surface of the wells and is delivered to the equipment via power cables that extend into the wells. The power cables are typically connected to the downhole equipment via "pothead" connectors that couple the power cable to the downhole equipment.

The environment downhole in a well may be very harsh. For instance, the temperature may be several hundred degrees, the fluids in the well may be corrosive, and particles in the fluids may be abrasive. These conditions can cause the components of an ESP system to degrade and possibly fail, thereby shortening the useful life of the ESP system.

High temperatures downhole are increasingly problematic. The temperature of the geological formation in which a well has been drilled is often high (e.g., 300 degrees F.) even in the absence of the downhole equipment. When an ESP system is operated downhole, it generates additional heat that increases the temperature around the system. The problem of high environmental temperatures is made even worse when techniques such as SAGD (steam assist, gravity drain) are employed to heat oil in the formation to reduce its viscosity and facilitating pumping.

The well environment may affect the power cabling and associated electrical junctions, as well as the ESP itself. For instance, temperature changes may cause the elastomeric materials that are used to form seals in the electrical junctions to expand and contract at rates which significantly differ from those of other materials used in the junctions. This may in turn cause the contact pressure of the seals against other components to vary from the ranges for which they were designed, which may result in leakage around the seals and consequent degradation and failure of the seals.

It would be desirable to provide improved means for providing seals in electrical junctions that reduce the effects of high temperatures and temperature changes in well environments on the seals are reduced.

SUMMARY OF THE INVENTION

This disclosure is directed to systems and methods for maintaining a desired compressive force on seals in an electrical junction such as a pothead connector for an ESP motor. This mechanism may be implemented in a variety of electrical connectors or other junctions to provide a reliable seal between the electrical conductors and surrounding components.

In one embodiment, a pothead connector is used to connect a power cable to a motor for an ESP system. The insulated conductors of the power cable extend into the housing of the pothead connector. The insulated conductors pass through an upper insulator, a set of elastomeric boot seals, and a lower insulator. O-rings are positioned between the upper insulator and the housing of the pothead connector. The lower insulator is secured to the upper insulator by a set of bolts and springs that urge the lower insulator toward the upper insulator, thereby compressing the boot seals. The bolts are threaded into the upper insulator and are tightened to compress the springs against the lower insulator. Because the lower insulator is urged toward the upper insulator by the springs, the compression of the boot seals between them remains relatively constant, even when temperature changes cause the relative dimensions of the components to change, or when well fluids cause the elastomeric material of the boot seals to swell.

Another embodiment comprises a system for coupling power to a piece of downhole equipment. The system includes an electric drive positioned at the surface of a well and a piece of downhole equipment positioned downhole in the well. A power cable has a first end coupled to the drive and extends into the well to a second end near the downhole equipment. At the second end of the power cable, the electrical conductors of the power cable (e.g., motor lead extensions) extend into a connector housing from the upper end of the housing. The terminal ends of the electrical conductors are positioned within the housing. A boot seal is positioned around each of the electrical conductors between an upper component and a lower component. The movable lower component is biased toward the boot seal and the upper component, so that a desired contact pressure is maintained against the boot seals.

The connector in this system may comprise a pothead connector that is configured to be secured to a motor head. The connector may use a set of springs which are held in position by a corresponding set of bolts to bias the movable lower component toward the boot seals and upper component. The upper component may be integral to the housing, or it may be a separate component that is positioned within the housing and sealed against the housing. In one embodiment, the upper component and movable lower component are electrical insulators.

Alternative embodiments may include pothead connectors as described above, splice connectors having structures similar to those described above, and methods of constructing and using these types of connectors. Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
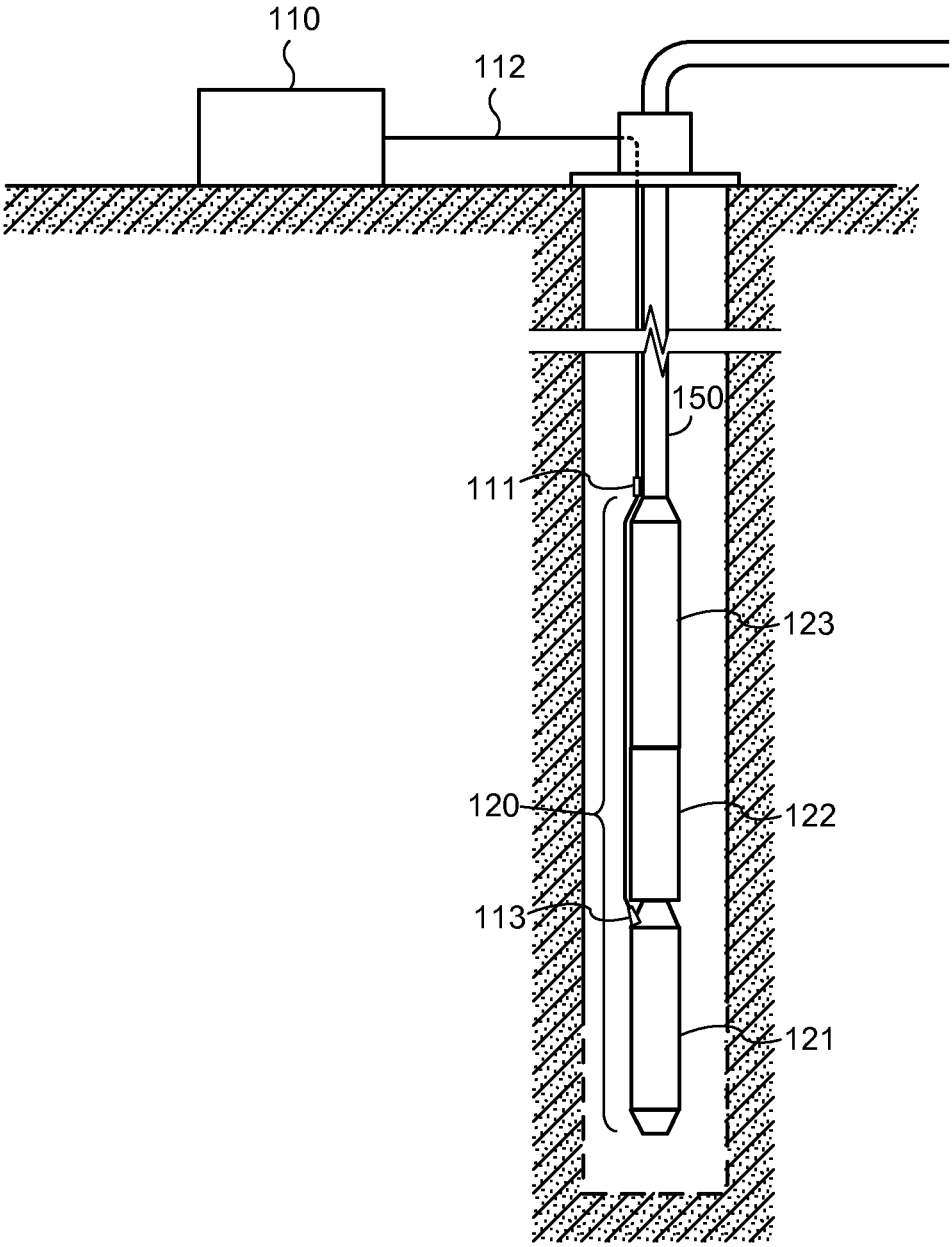
FIG. 1 is a diagram illustrating an exemplary ESP system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention. Further, the drawings may not be to scale, and may exaggerate one or more components in order to facilitate an understanding of the various features described herein.

DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for minimizing variations in contact pressure applied to elastomeric seals in electrical junctions that are used to provide power to downhole equipment such as ESPs.

In one exemplary embodiment, a pothead connector is used to connect a set of motor lead extensions to a motor for an ESP system. The insulated conductors of the motor lead extensions extend into the housing of the pothead connector, where they are coupled to a corresponding set of female end connectors (terminals). The insulated conductors pass through an upper insulator, a set of elastomeric boot seals, and a lower insulator. The lower insulator is secured to the upper insulator by a set of bolts and springs that urge (bias) the lower insulator toward the upper insulator, thereby compressing the boot seals. The bolts are threaded into the upper insulator and are tightened to compress the springs against the lower insulator. Because the lower insulator is urged toward the upper insulator by the springs, the compression of the boots seals between them remains relatively constant (i.e., within an acceptable range), even when temperature changes cause the relative dimensions of the components to change, or when well fluids cause the elastomeric material of the boot seals to swell.

Referring to FIG. 1, a diagram illustrating an exemplary system in accordance with one embodiment of the present invention is shown. In this embodiment, an ESP system is installed in a well for the purpose of producing oil, gas or other fluids. An ESP 120 is coupled to the end of tubing string 150, and the ESP and tubing string are lowered into the wellbore to position the ESP in a producing portion of the well (as indicated by the dashed lines at the bottom of the wellbore). Surface equipment that includes a drive system 110 is positioned at the surface of the well. Drive system 110 is coupled to ESP 120 by power cable 112, which runs down the wellbore along tubing string 150. Tubing string 150 and power cable 112 may range from less than one thousand feet in a shallow well, to many thousands of feet in a deeper well.

ESP 120 includes a motor section 121, seal section 122, and pump section 123. ESP 120 may include various other components which will not be described in detail here because they are well known in the art and are not important to a discussion of the invention. Motor section 121 is operated to drive pump section 123, thereby pumping the oil or other fluid through the tubing string and out of the well. Drive system 110 produces power (e.g., three-phase AC power) that is suitable to drive motor section 121. This output power is provided to motor section 121 via power cable 112.

Power cable 112 may, for example, include two components: a primary cable component and a motor lead component. The primary cable extends downward along the tubing string from the drive unit at the surface of the well to a point near the ESP. At this point (typically 10-50 feet above the ESP), the primary cable is connected to the motor lead by a splice 111. The motor lead extends from the primary cable to the motor, and is connected to the motor by a connector 113, which may be referred to as a "pothead". At the pothead, the electrical conductors of the motor lead are coupled to the internal wiring of the motor.

The primary cable typically has three conductors to carry three-phase power to the motor. Each conductor has one or more layers of electrical insulation. The conductors may be positioned side-by-side to form a flat cable, or they may be positioned adjacent to each other (i.e., 120 degrees apart) to form a round cable. An elastomeric coating may be provided to encase the three conductors, and a metal layer may be provided over the elastomeric layer to protect the insulated conductors.

The motor lead is coupled to the primary cable, normally by splicing the respective conductors together. The conductors of the motor lead have one or more layers of electrical insulation and are usually encased in an elastomeric layer. The conductors are typically positioned side-by-side in a flat configuration, and the conductors of the motor lead may be smaller than the conductors of the primary cable to allow the motor lead to fit more easily between the ESP and the well casing. A metal layer may be provided over the elastomeric layer to protect the insulated conductors.

The motor lead is coupled to the primary cable, normally by splicing the respective conductors together. This splice may be achieved by coupling a splice connector between the end of each of the conductors of the primary cable and the corresponding conductor of the motor lead. Thus, three splice connectors would be used to couple the three conductors of the primary cable to the three conductors of the motor lead. At the other end of the motor lead, each of the conductors of the motor lead is connected to a corresponding terminal in the pothead connector. The pothead is secured to the motor housing with its terminals connected to complementary terminals of the motor.

Figure 2:
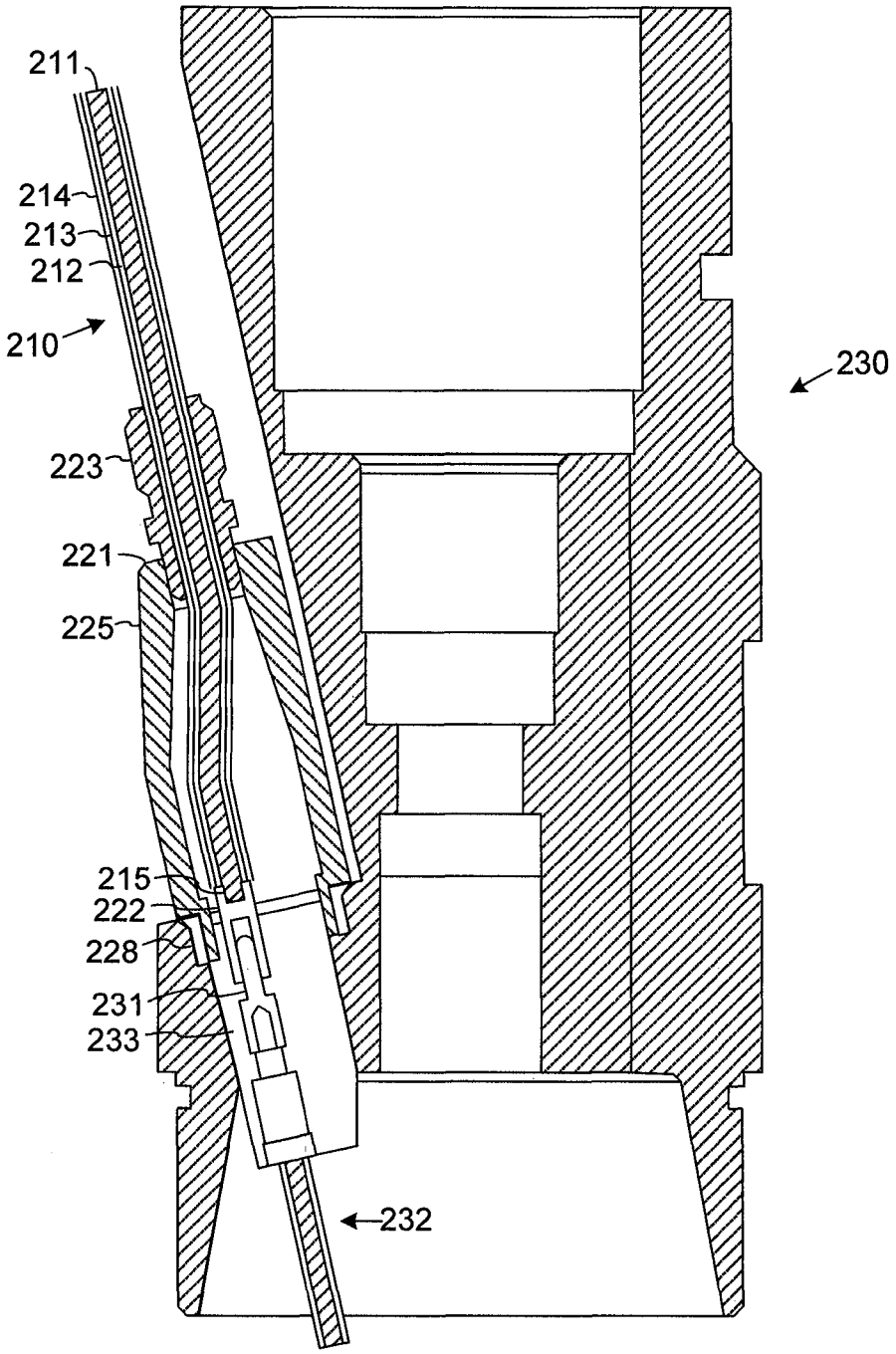
FIG. 2 is a diagram illustrating the structure of a pothead connector installed at the top of an ESP motor in accordance with one embodiment.

Referring to FIG. 2, a cutaway view of a pothead connector installed at the top of an ESP motor is shown. The illustrated structures are exemplary, and may differ from one embodiment to another. In this embodiment, motor lead 210 is coupled to pothead connector 220, which is secured to motor head 230. A housing seal 228 is positioned at a lower end of housing 225 to seal the housing against the motor head. A single one of the conductors of motor lead 210 is depicted in the figure. Electrical conductor 211 is encased in a layer of electrical insulation 212. A layer of elastomeric material 213 covers insulating layer 212. A protective metal layer 214 is provided to prevent damage to the motor lead when the motor is installed in the well.

Conductor 211 passes through ferrule 223 at an upper or lead end of pothead connector 220 and into the body of the connector. The terminal end (215) of conductor 211 is connected to a conductive female terminal 222, which is positioned at a lower or motor end of the pothead connector.

Female terminal 222 is configured to mate with a male terminal 231 installed in an insulating block 233 in motor head 230. Male terminal 231 is electrically coupled to the internal wiring 232 of the motor.

Figure 3:
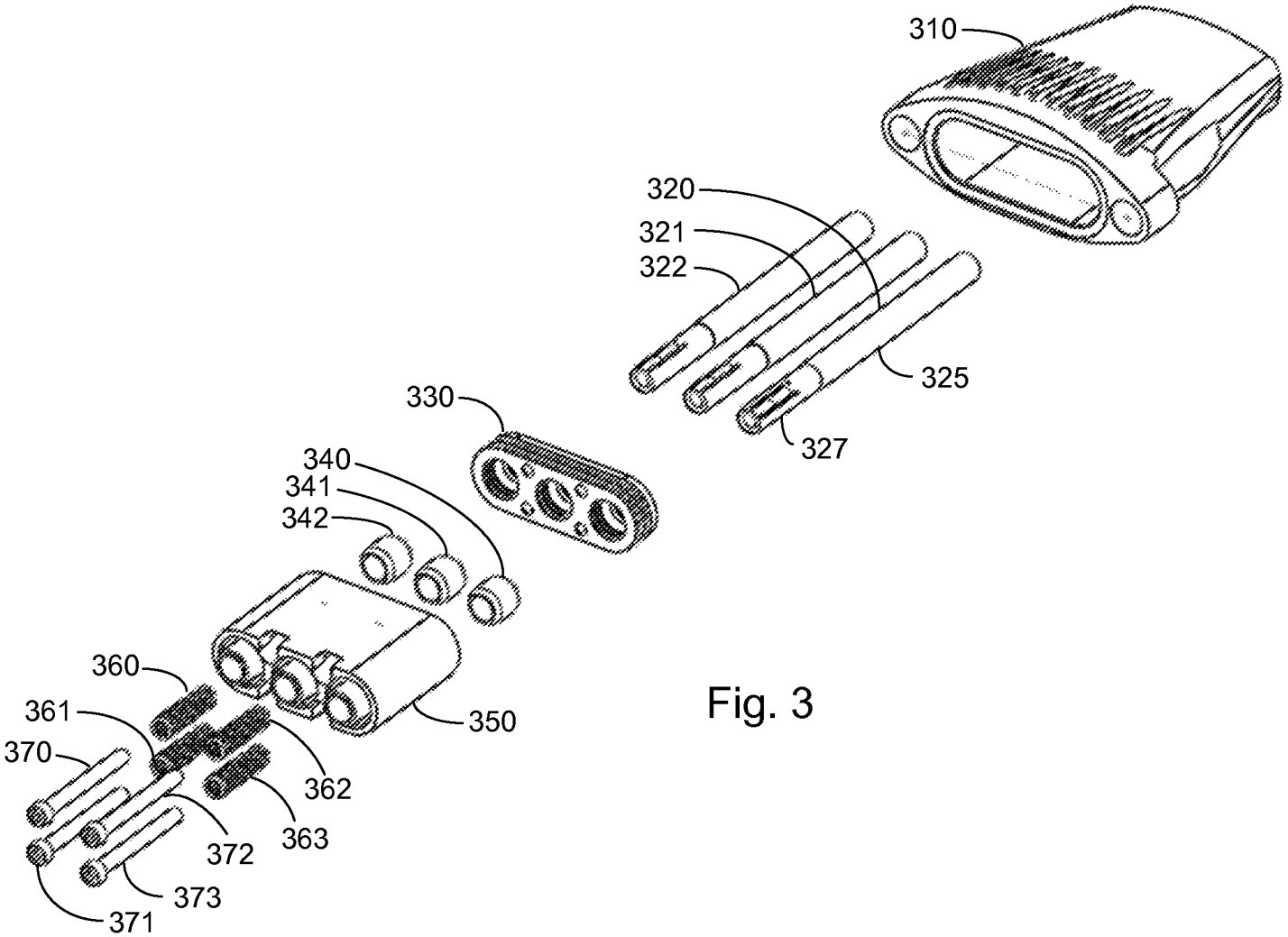
FIG. 3 is an exploded view of the components of an exemplary pothead connector.
Figure 4:
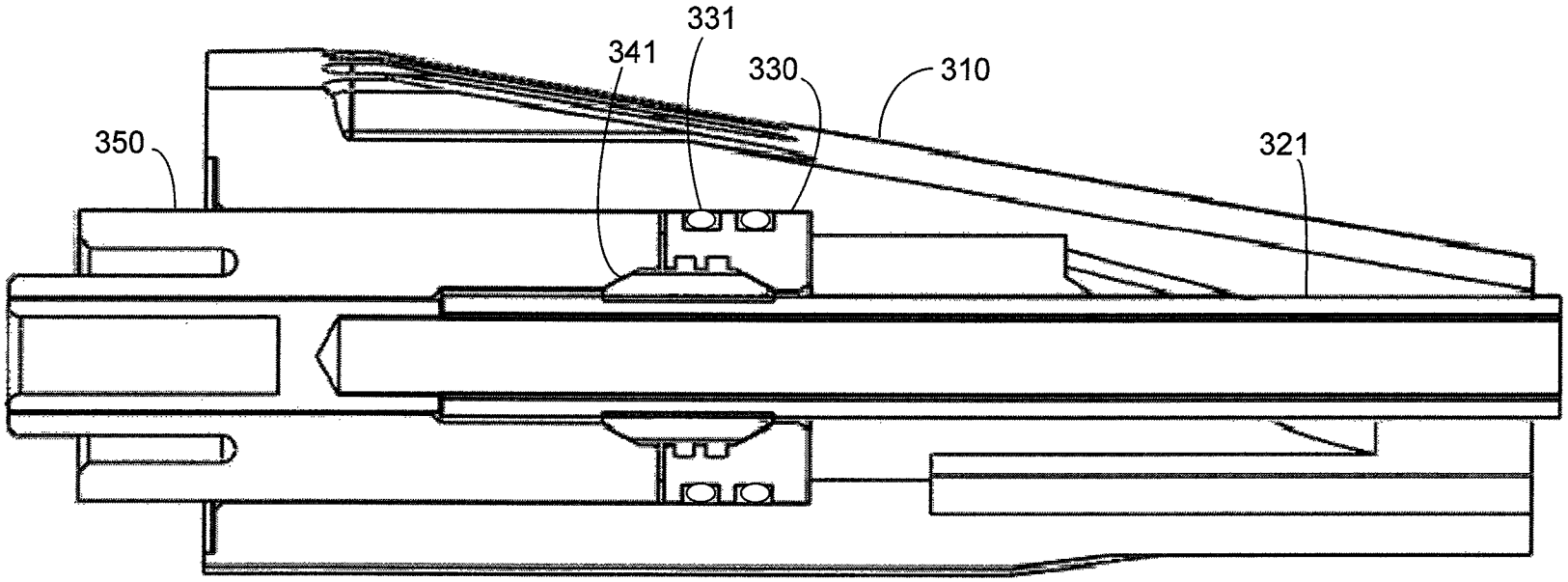
FIG. 4 is a cross-sectional view of the assembled pothead connector of FIG. 3 through one of the conductors.
Figure 5:
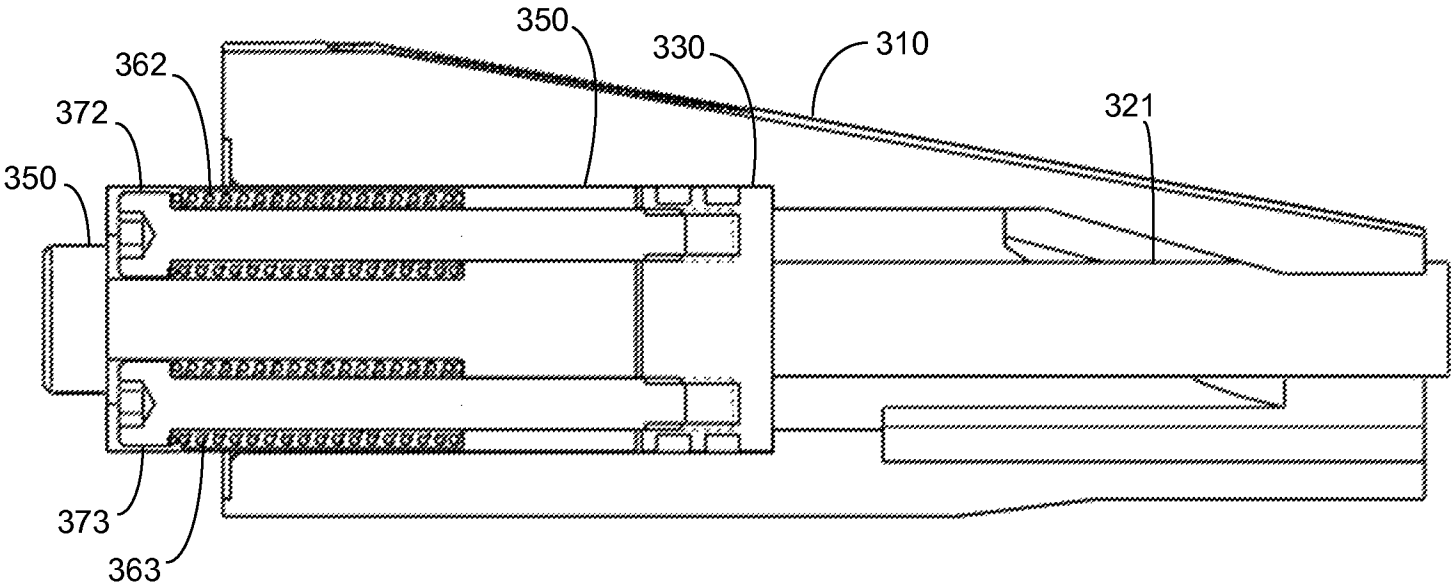
FIG. 5 is a cross-sectional view of the assembled pothead connector of FIG. 3 through a portion of a spring mechanism.

Referring to FIGS. 3-5, a set of diagrams illustrating an exemplary pothead connector in accordance with one embodiment is shown. FIG. 3 is an exploded view of the components of the pothead connector. FIG. 4 is a cross-sectional view of the pothead connector through one of the conductors. FIG. 5 is a cross-sectional view of the pothead connector through a portion of a spring mechanism.

The components of the pothead connector are contained in a housing 310. The conductors of the power cable (or motor lead extension) pass through an opening in the upper end of housing 310 (on the right side of FIGS. 320-322) and into the pothead connector. Each of conductors 320-322 has a layer of insulation (e.g., 325) around it. The insulation is stripped back to expose the end of each conductor so that a female end connector/terminal (e.g., 327) can be coupled to the end of the conductor. The other end of the end connector will accommodate a male terminal in the motor head.

An upper insulator 330 is positioned between conductors 320-322 and housing 310. Upper insulator 330 has three apertures through it, and each one of the conductors extends through a corresponding one of the apertures. In order to prevent fluid leakage through the pothead connector from the face of the connector to the rear of the conductor, the upper insulator must be sealed against both housing 310 and the individual conductors (320-322). O-rings or other types of upper insulator seals 331 are positioned between upper insulator 330 and housing 310 to seal between these two components. Boots 340-342 (sometimes also referred to as boot seals or football seals) are positioned so that a portion of each boot is between conductors 320-322 and upper insulator 330 to seal between these components.

Lower insulator 350 has three passages through it to accommodate the three conductors (320-322). The female end connectors (e.g., 327) are positioned within a front end of lower insulator 350 so that they can be coupled to the corresponding male terminals of the motor. Lower insulator 350 contacts each of boots 340-342, and is fastened to upper insulator 330 so that the boots are compressed between them. This increases the contact pressure between boots 340-342 and upper insulator 330, as well as between the boots and conductors 320-322. Lower insulator 350 is movably secured to upper insulator 330 by springs 360-363 and bolts 370-373.

As shown in FIG. 5, bolts 370-373 extend through lower insulator 350 are threaded into upper insulator 330. Each of springs 360-363 is positioned around a corresponding one of bolts 370-373 and is compressed between the head of the bolt and lower insulator 350, thereby pushing the lower insulator toward upper insulator 330 and compressing boots 340-342 between the shoulders or seats of the upper and lower insulators (the faces of the insulators that contact the boots). The amount of force applied by the upper and lower insulators to the boots can be adjusted by tightening/loosening the bolts, or by changing the spring constant of the springs.

It should be noted that the upper insulator and lower insulator need not be made of insulating material. They may instead be made of metal or other materials that are less susceptible to changes resulting from exposure to the well environment.

Prior to the invention, a pothead connector could be constructed using a similar arrangement of boots compressed between upper and lower insulators, but the lower insulator would be held against the upper insulator by the bolts alone. One of the problems with this arrangement is that, in order to obtain the desired compression of the boots, the bolts would have to be tightened to within very tight tolerances of desired torques. This required a great deal of skill and time in the assembly of the pothead connector. Another problem with this arrangement is that, when the components of the pothead connector are exposed to the well environment, increased temperatures, temperature cycling and exposure to well fluids cause the relative dimensions of the components (particularly the boots) to change, which in turn affects the contact pressure between the boots and the surrounding components. This could cause leakage or failure of the corresponding seals, thereby shortening the useful life of the pothead connector.

In the present systems and methods, the use of springs between the bolts and the lower insulator allows the lower insulator to move with respect to the upper insulator, while maintaining contact pressure on the boots that is more nearly constant. Even when the components of the pothead connector expand, contract or undergo dimensional or other changes that would typically result in altered contact pressure at the boots, the springs maintain a relatively constant pressure on the boots. The boots therefore remain within the desired contact pressure range and maintain the seal between the boots and the upper insulator, as well as between the boots and the insulated conductors.

It should be noted that the foregoing embodiment is intended to be exemplary, rather than limiting. Alternative embodiments may include more or fewer features than the embodiment described above, the included features may be provided by alternative components or alternative materials, and the features may be provided in alternative electrical junctions. For instance, one alternative embodiment may be implemented in a connector for a power cable splice rather than a pothead connector. In another embodiment, the spring pressure may be provided by wave springs or other non-coil springs. In another embodiment, pressure may be applied to the boot seals by components other than the upper and lower insulators. In another embodiment, the upper insulator may be integral to the housing. In another embodiment, fasteners other than bolts may be used to secure the springs and lower insulator against the upper insulator. In another embodiment, the spring pressure may be applied to elastomeric seals other than boot seals. Still other embodiments will be apparent to those of skill in the art of the invention upon reading this disclosure.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A system for coupling power to a piece of downhole equipment, the system comprising:

an electric drive positioned at the surface of a well;

a piece of downhole equipment positioned downhole in the well;

a power cable having a first end coupled to the drive and extending into the well to a position proximate to the piece of downhole equipment;

wherein at a second end of the power cable, one or more electrical conductors, each having a terminal end, extend into a housing of a connector, wherein the electrical conductors are positioned to extend through an upper end of the housing, and wherein the terminal ends of the electrical conductors are positioned within the housing;

one or more boots seals, wherein each boot seal is positioned around a corresponding one of the electrical conductors;

an upper shoulder within the housing, wherein the boot seals are positioned in contact with the upper shoulder, wherein the upper shoulder is formed on an upper electrical insulator that is positioned within the housing; and a movable lower shoulder component positioned in contact with the boot seals on a side of the boot seals opposite the upper shoulder;

wherein the movable lower shoulder component is biased toward the upper shoulder, thereby enabling the movable lower shoulder component to move alternately toward and away from the upper shoulder while maintaining a desired contact pressure against the boot seals.

2. The system of claim 1, wherein the connector comprises a pothead connector that is configured to be secured to a motor head.

3. The system of claim 1, wherein the boot seals prevent fluid leakage between the upper shoulder and the electrical conductors.

4. The system of claim 1, further comprising an upper insulator seal that is positioned between the upper insulator and the housing, wherein the upper insulator seal prevents fluid leakage between the upper insulator and the housing.

5. The system of claim 1, wherein the movable lower shoulder component comprises a lower electrical insulator.

6. The system of claim 1, further comprising a housing seal positioned at a lower end of the housing to seal the housing against the piece of downhole equipment.

7. The system of claim 1, wherein the one or more electrical conductors comprise one or more motor lead extensions.

8. The system of claim 1, further comprising one or more springs that contact the movable lower shoulder component and bias the movable lower shoulder component toward the upper shoulder.

9. The system of claim 8, further comprising one or more fasteners that hold the springs on a side of the movable lower shoulder component opposite the boots seals, wherein the springs are compressed by the fasteners against the movable lower shoulder component so that the springs bias the movable lower shoulder component against the boot seals.

10. A connector for coupling power cable to a piece of downhole equipment, the connector comprising:

one or more electrical conductors, each of the electrical conductors having a terminal end;

a housing, wherein the electrical conductors are positioned to extend through an upper end of the housing into the housing, and wherein the terminal ends of the electrical conductors are positioned within the housing;

one or more boots seals, wherein each boot seal is positioned around a corresponding one of the electrical conductors;

an upper shoulder within the housing, wherein the boot seals are positioned in contact with the upper shoulder, wherein the upper shoulder is formed on an upper electrical insulator that is positioned within the housing; and a movable lower shoulder component positioned in contact with the boot seals on a side of the boot seals opposite the upper shoulder;

wherein the movable lower shoulder component is biased toward the upper shoulder, thereby enabling the movable lower shoulder component to move alternately toward and away from the upper shoulder while maintaining a desired contact pressure against the boot seals.

11. The connector of claim 10, wherein the connector comprises a pothead connector that is configured to be secured to a motor head.

12. The connector of claim 10, wherein the boot seals prevent fluid leakage between the upper shoulder and the electrical conductors.

13. The connector of claim 10, further comprising an upper insulator seal that is positioned between the upper insulator and the housing, wherein the upper insulator seal prevents fluid leakage between the upper insulator and the housing.

14. The connector of claim 10, wherein the movable lower shoulder component comprises a lower electrical insulator.

15. The connector of claim 10, further comprising a housing seal positioned at a lower end of the housing to seal the housing against the piece of downhole equipment.

16. The connector of claim 10, wherein the one or more electrical conductors comprise one or more motor lead extensions.

17. The connector of claim 10, further comprising one or more springs that contact the movable lower shoulder component and bias the movable lower shoulder component toward the upper shoulder.

18. The connector of claim 17, further comprising one or more fasteners that hold the springs on a side of the movable lower shoulder component opposite the boots seals, wherein the springs are compressed by the fasteners against the movable lower shoulder component so that the springs bias the movable lower shoulder component against the boot seals.

* * * * *